US005499427A

United States Patent [19]

Bowman

[11] Patent Number: 5,499,427

[45] Date of Patent: Mar. 19, 1996

[54] DRAWER KNOB ASSEMBLY

[75] Inventor: Myrlen L. Bowman, Gresham, Oreg.

[73] Assignee: Blaser Die Casting Co., Seattle, Wash.

[21] Appl. No.: 300,040

[22] Filed: Sep. 2, 1994

[51] Int. Cl.[6] ..... F16K 31/60

[52] U.S. Cl. ..... 16/121; 16/110 R; 40/331; 292/347

[58] Field of Search ..... 16/110 R, 114, 16/121; 40/331; 292/347, 348, 350

[56] References Cited

U.S. PATENT DOCUMENTS

| | | | |
|---|---|---|---|
| 841,284 | 1/1907 | Tower | 16/121 |
| 1,755,301 | 4/1930 | McCullough | 161/121 |
| 1,958,165 | 5/1934 | Le Compte | 16/121 |
| 2,507,392 | 5/1950 | Williams | 16/121 |
| 4,220,054 | 9/1980 | Kuhlman | 16/121 |

OTHER PUBLICATIONS

One page—Wood Knob Inserts.

*Primary Examiner*—W. Donald Bray
*Attorney, Agent, or Firm*—Chernoff, Vilhauer, et al.

[57] ABSTRACT

A knob assembly for drawers and the like comprises an integral knob having a flat base member, a longitudinally-extending stem connected at one end to the base member and a threaded bore opening in a second stem end for receiving a screw fastener therein. An insert piece having a top portion and a recessed shoulder portion extending around the perimeter of the top portion is received by a collar having a central opening size to receive the top portion of the insert while blocking the passage of the shoulder portion of the insert therethrough. The collar is adapted to be crimped so as to securely engage the base member by its periphery.

2 Claims, 1 Drawing Sheet

DRAWER KNOB ASSEMBLY

BACKGROUND OF THE INVENTION

The present invention relates to a knob assembly for drawers and the like, and more particularly to an improved drawer knob of the type having an insert embedded into the face thereof.

A conventional design for a drawer knob includes a circular base member and a rearwardly-extending stem portion connecting the base member to a suitable surface such as the front of a bureau drawer. Typically, a centrally located recess is provided on the face of the base member for receiving a decorative insert for enhancing the appearance of the assembled knob. The insert is usually affixed within the recess by a suitable adhesive, such as glue. However, adhesive bonds are not especially strong and periodically fail, permitting the insert to become detached from the base portion of the knob. Such an insert, once detached, presents a serious hazard to infants and small children as it is prone to being placed in the mouth and thereby cause choking.

What is desired, therefore, is a knob which includes a decorative insert on the face thereof that is securely attached to the knob assembly and not prone to becoming detached.

SUMMARY OF THE INVENTION

The present invention overcomes the aforementioned drawbacks of the prior art by providing a knob assembly of the type having a decorative insert piece securely embedded in the face thereof which is strongly resistant to removal. The knob assembly comprises a flat base member, a longitudinally-extending stem connected at one end to the base member and having a threaded bore opening in its other end for receiving a screw fastener therein. A decorative insert piece, having a top portion and a recessed shoulder portion extending around the perimeter of the top portion, is matched with a collar having a central opening sized to receive the top portion of the insert piece, while blocking the passage of the shoulder portion of the insert piece. The collar is adapted to be crimped so as to securely engage the base member by its periphery.

The knob assembly of the present invention includes a collar that mechanically restrains the insert piece between the base and the collar. This mechanical restraint eliminates the prior necessity for an adhesive bond which frequently proves insecure in use.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
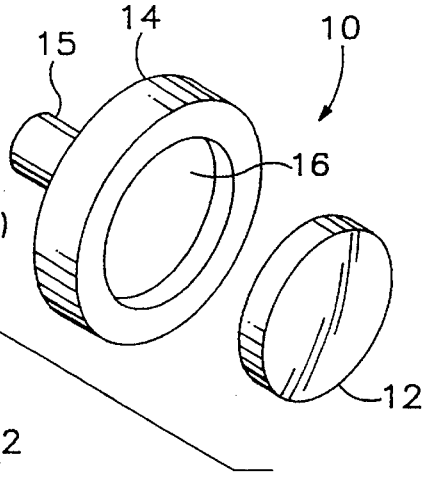
Fig.1 (PRIOR ART)
FIG. 1 is an exploded view of a conventional prior art knob.
Figure 2:
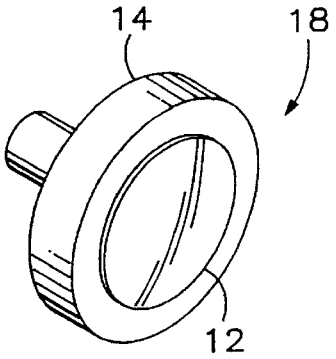
Fig.2 (PRIOR ART)
FIG. 2 is a perspective view, in assembled form, of the prior art knob of FIG. 1.

Referring to FIGS. 1 and 2, a conventional prior art design for a drawer knob 10 of the type which includes an insert 12 comprises a circular base 14 having a recess 16 therein sized to receive the insert. A rearwardly-extending stem 15 is attached to the knob 10 for connecting the base 14 to a surface, such as the front of a drawer or door. The base 14 is constructed of any suitable material, such as metal, and the insert 12 is constructed of a decorative material to enhance the appearance of the knob. In the assembly of the conventional knob, a suitable adhesive, such as glue, is placed within the recess 16, and then the insert 12 is pressed into the recess 16 to secure the insert 12 to the base 14.

Figure 3:
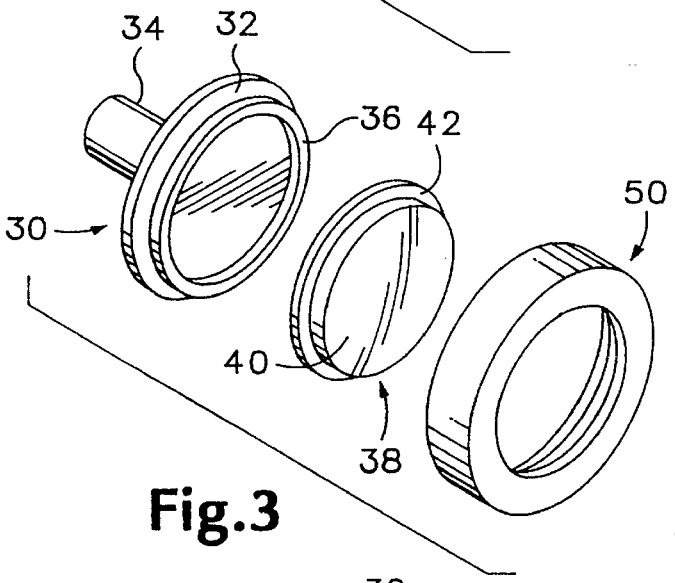
FIG. 3 is an exploded view of an exemplary embodiment of the improved knob assembly of the present invention.
Figure 4:
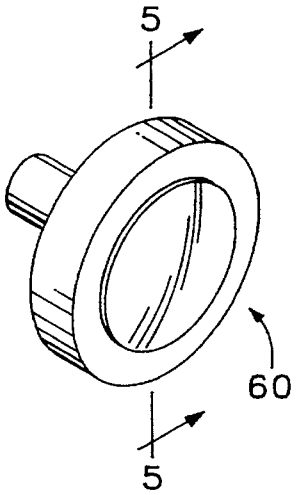
FIG. 4 is a perspective view, in assembled form, of the knob embodiment of FIG. 3.
Figure 5:
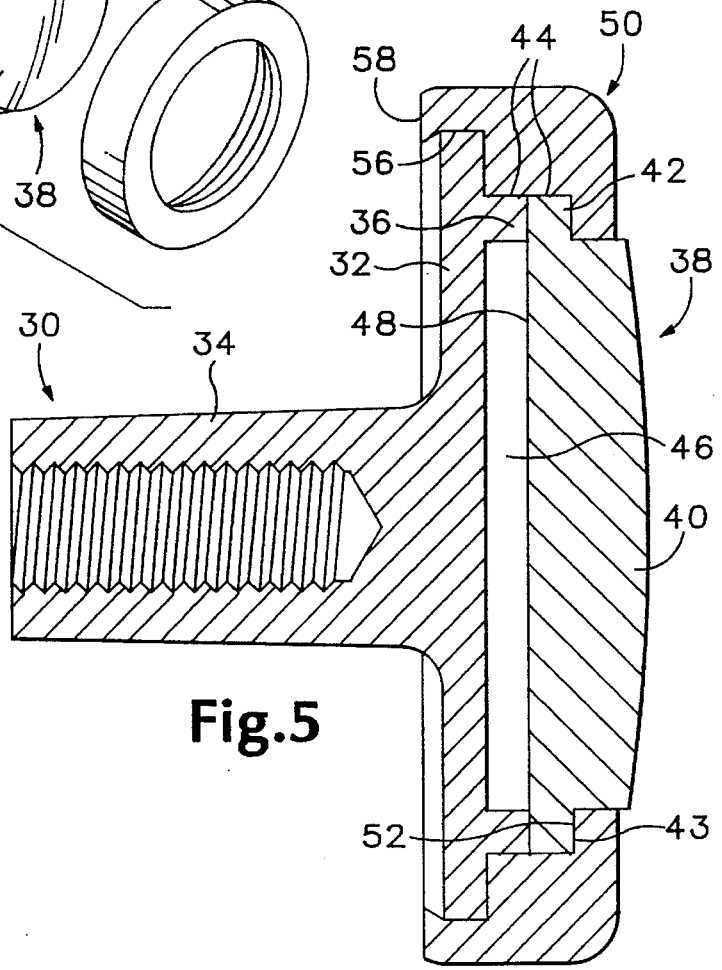
FIG. 5 is an enlarged cross-sectional view of the knob assembly taken along line 5—5 of FIG. 4.

Referring to FIG. 3, the improved integral knob 30 of the present invention is of integral (one-piece) construction, and comprises a flat circular base member 32, an interior ring portion 36 elevated above the surface of the base member 32, and a longitudinally-extending stem portion 34 connected at one end to the base member 32 opposite the elevated ring portion 36. Further referring to FIG. 5, the stem 34 includes a threaded bore opening 38 in its other end for receiving a screw fastener therein to connect the integral knob assembly 30 to a suitable surface, such as a drawer or door. The elevated ring portion 36 supports an insert piece 38 thereon. The insert piece 38 has a top portion 40 and a recessed shoulder portion 42 extending around the perimeter of the top portion 40. As shown in FIG. 4, the insert piece 38 is preferably constructed of a decorative material, such as wood, plastic or ceramic, for ornamenting the front of the knob assembly 60.

The recessed shoulder portion 42 of the insert piece 38 has the same outside diameter as the elevated ring portion 36 of the integral knob 30 to create a flush outer surface 44 between them when they are properly centered and pressed against each other. A space 46 is formed between the bottom surface 48 of the insert piece 38 when it is pressed against the elevated ring portion 36 on the base member 32. The space 46 allows a thinner insert piece 32 to be used while maintaining the same thickness of the knob assembly 60. Also, the space 46 provides a suitable location for the application of an optional glue layer for added securement of the insert piece 38 to the integral knob 30.

A collar 50 has a central opening sized to receive therethrough the top portion 40 of the insert piece 38 while blocking passage of the recessed shoulder portion 42 of the insert piece 38. When the collar 50 is matingly engaged to the insert piece 38, an interior surface 52 of the collar 50 abuts the top surface 43 of shoulder portion 42. The collar 50 and insert piece 38 are assembled on the integral knob 30 with a lower interior surface 56 of the collar 50 sized to correspond to the perimeter of the base member 32. The collar 50 is securely engaged to the integral knob 30 by crimping the base 58 of the collar about the base member 32.

Overall, the base member 32 and elevated ring portion 36 of the integral knob 30 maintains the position of the affixed collar 50. The collar 50, in turn, retains the insert piece 38 against the elevated ring portion 36, in a manner that is strongly resistant to removal, without need for an adhesive bond at the joint. Referring to FIG. 4, it will be noted that the knob assembly 60 of the present invention has a similar outward appearance to the conventional knob 18 of FIG. 2.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A knob assembly for drawers and the like comprising:

(a) an integral knob having a flat base member, a longitudinally-extending stem connected at a first stem end to said base member and a threaded bore opening in a second stem end for receiving a screw fastener therein;

(b) an insert piece having a top portion and a recessed shoulder portion extending around the perimeter of said top portion; and (c) a collar having a central opening sized to receive therethrough said top portion of said insert but blocking the passage of said shoulder portion of said insert, said collar being adapted to be crimped so as to securely engage said base member by its periphery.

2. The knob assembly of claim 1 further comprising an elevated ring affixed to said base member to support said insert piece in a spaced-apart relationship from said base member when said collar is engaged to said base member.

* * * * *